US012392591B2

(12) United States Patent
Queiroz De Aguiar

(10) Patent No.: US 12,392,591 B2
(45) Date of Patent: Aug. 19, 2025

(54) ELECTRONIC TIME WARHEAD FUZE

(71) Applicant: Condor S.A. Industria Química, Nova Iguaçu/RJ (BR)

(72) Inventor: Carlos Frederico Queiroz De Aguiar, Nova Iguaçu/RJ (BR)

(73) Assignee: CONDOR S.A. INDÚSTRIA QUÍMICA, Adrianópolis-Nova Iguaçu/RJ (BR)

( * ) Notice: Subject to any disclaimer, the term of this patent is extended or adjusted under 35 U.S.C. 154(b) by 0 days.

(21) Appl. No.: 18/403,387

(22) Filed: Jan. 3, 2024

(65) Prior Publication Data

US 2024/0230296 A1 Jul. 11, 2024

(30) Foreign Application Priority Data

Jan. 6, 2023 (BR) ..... 10 2023 000347 8

(51) Int. Cl.
*F42C 11/00* (2006.01)
*F42C 11/04* (2006.01)

(52) U.S. Cl.
CPC ..... *F42C 11/003* (2013.01); *F42C 11/04* (2013.01)

(58) Field of Classification Search
CPC ..... F42C 11/003; F42C 11/04
USPC ..... 102/487
See application file for complete search history.

(56) References Cited

U.S. PATENT DOCUMENTS 3,941,058 A * 3/1976 Gawlick ..... F42C 14/025 102/210
8,887,640 B1 * 11/2014 Knight ..... F42C 14/025 102/210
10,088,288 B1 * 10/2018 Caska ..... F42C 14/025
2015/0292848 A1 * 10/2015 Wigg ..... F42C 11/06 102/487

FOREIGN PATENT DOCUMENTS

IT 0781975 A2 * 7/1997

* cited by examiner

*Primary Examiner* — Samir Abdosh
(74) *Attorney, Agent, or Firm* — Sheridan Ross P.C.

(57) ABSTRACT

An electronic time warhead (EOT) fuze for a hand grenade comprises a body housing a clamp with two terminals maintaining a spring and a handle in the armed position. The handle holds the spring in the armed position while the user wields the grenade. The spring is housed in a spring pin and this initializes the EOT. When throwing the grenade, the spring seeks a resting position, expelling the handle and activating a switch that energizes an electronic circuit. A battery is electrically connected to the electronic circuit. In addition, an initiator element is mounted on the body and the initiator element consists of a conductive filament impregnated with a chemical mixture generating a flame from the electrical signal applied by the electronic circuit. The initiating element can be an electrical or electronic component. The electronic circuit accounts for a delay time until the grenade's initiating flame is effectively activated. In some embodiments, the electronic circuit is a microprocessor circuit that applies the electrical signal to the conductive filament at the end of the delay time, activating the grenade.

6 Claims, 4 Drawing Sheets

ELECTRONIC TIME WARHEAD FUZE

CROSS-REFERENCE TO RELATED APPLICATION

This application claims the benefit of Brazil Patent Application No. BR 10 2023 000347 8 filed Jan. 6, 2023, the entire contents of which are incorporated herein by reference in its entirety.

TECHNICAL FIELD

The present invention relates to an electronic time warhead (EOT) fuze with an electronic circuit to trigger a delay time until an effective triggering of a grenade.

BACKGROUND

EOT-type initiation systems are currently known to be used in hand grenades with the aim of initiating the artifact after the throw and adding a delay time until effective activation. The purpose of this delay is to ensure a minimum safe distance between the operator and the trigger point.

The U.S. Pat. No. 8,887,640 consists of a security fuze that includes a magnetic attack generator (MSG) as its energy generation source. The MSG provides energy to power an electronic unit and a security and arming device. The safety fuze enables the safety and arming of military hand grenades, with a fully offline explosive primer and an integrated means of power generation, to improve safety and performance. The MSG includes a striker and a receiver coil that houses a conductive coil. The striker comprises a permanent magnet that is mounted on a pivot mechanism to allow a rotational displacement of the permanent magnets, into the coil, in order to generate an electric current. As the permanent magnet is being inserted into the coil, the exchange of the magnetic flux induces an electrical current in the coil, creating the energy needed to operate the fuze.

The European patent EP 0781975 B1 consists of conventional mechanical transport and equipped with safety devices and safety devices that work mechanically and electronically. An original electrical power supply system. An electronic delay instead of a pyrotechnic delay. An explosive chain that passes unaligned in line, and capable of triggering the detonation of the main charge in a hand grenade. The energy required for its function is stored in a spring 205 that drives an electrical generator 501, which improves the safety of storage, control and use, and the repeatability of the delay at any temperature, while substantially extending its service life.

The U.S. Pat. No. 6,965,542 consists of a simulated grenade for MILES-type simulations that generates a single RF signal and a single audio signal. A detector uses the time between receiving the RF signal and the slowest path audio signal to determine the distance between the detector and the simulated grenade.

In conventional EOTs, the delay is generated through a chemical mixture that has a known average burning time. Thus, when a grenade is thrown, a flame is immediately generated that starts burning this delay mixture, which after a few seconds transfers the flame to the effective part of the system, therefore creating a safety delay between the moment of launch and the drive.

In addition, the prior art uses drive principles such as electric spark generated from transformer coils.

To address the drawbacks of the above prior art and prevent inaccuracy in the delay time, as well as simplify the electrical circuit and the method of triggering the grenade, the present invention relies on an electronic circuit and a filamentary conductor driven as an initiating element of the grenade. Therefore, the present invention presents microprocessor systems capable of accounting for delay time with microsecond isolation. Furthermore, it allows the use of common items on the market and with reduced dimensions. Based on the problems surrounding chemical retardation, in which inaccuracy is the main one, triggered the need to develop a solution in which an electronic circuit can generate a grenade-initiating flame. Variations derived from the raw material and production processes directly affect the burning time of the mixture, therefore resulting in inaccuracy in the EOT delay. The order of inaccuracy is in the order of tenths of seconds.

Other factors that contribute to the inaccuracy of systems that use chemical retardation are storage conditions and time. In other words, a grenade that is left in unsuitable weather conditions or stored for a longer time may suffer variations in delay time.

And finally, designing the chemical mixture for longer delay times is not a simple task and in some cases is even impossible. As it is the burning of the mixture that results in the delay, a system with greater delay requires a less sensitive and slower burning mixture, which can cause loss of activation in many cases.

SUMMARY

The present invention has as one of its objectives to provide an electronic time warhead fuze (EOT) initiation system for initiating a grenade, in which an electronic circuit is constructed to count the time and generate an initiating flame of the grenade. The proposed EOT simplifies the electrical circuit and the method of triggering the grenade, enabling the use of common items on the market and with reduced dimensions. In some embodiments of the present invention, other drive principles may be used, such as an electric spark generated from transformer coils.

In addition, another objective is to provide microprocessor systems that have precision on the microsecond scale in addition to the ability to account for delays ranging from fractions of a second to minutes if necessary. This feature gives the present invention a high degree of precision as well as flexibility in programming the delay time.

Another important objective is to provide a grenade initiating element consisting of a conductive filament impregnated with a highly sensitive chemical mixture. At the end of the delay time, the microprocessor applies an electrical signal to the conductive filament, generating heat, which sensitizes the mixture and results in a flame for the grenade. The great advantage of this element is the possibility of generating a flame from low voltage values, enabling the use of conventional batteries.

The present invention proposes a solution to the drawbacks of the prior art by means of a hand grenade with an EOT-type initiation system with an electronic circuit built to count time and generate the grenade's initiating flame. The grenade is made up of a body that is a polymer piece where all the mechanisms are assembled and housed.

Some elements are present in the body, such as a clamp, a handle, a spring, a spring pin, a switch, a battery, an electronic circuit and a starter element.

The clamp consists of the system lock that keeps the spring and handle in the armed position, preventing the EOT from being initiated and consequently the grenade from being triggered. Furthermore, the clamp has two terminals that keep the handle locked in the EOT body, ensuring that the spring remains in the armed position.

The handle is the component that keeps the spring in the armed position while the user is wielding the grenade.

The spring is responsible for initializing the EOT. When the user throws the grenade, the spring returns to the rest position, expelling the handle and activating the switch that energizes the electronic circuit.

The spring pin is used to house the spring in the EOT body.

The battery is used as a power source for the system.

The electronic circuit is a microprocessor circuit to account for the delay time and to generate the electrical drive signal.

The initiator element consists of a conductive filament impregnated with a highly sensitive chemical mixture. Its objective is to generate flame from the electrical signal applied by the electronic circuit.

When removing the clamp and launching, the spring will seek the rest position, expelling the EOT handle.

Upon reaching the rest position, the spring puts pressure on a switch button, creating a short circuit between its terminals. At this point, the battery is electrically connected to the electronic circuit.

When energized, the circuit counts the delay time and generates an electrical signal on the starter filament. This signal generates heat and activates the chemical mixture, resulting in the flame that triggers the grenade.

Furthermore, the system has embedded software to count a pre-programmed amount of time and generate a specific electrical signal at the end. This signal results in enough heat to generate a flame and consequently trigger the grenade. At the end it goes into an infinite loop to prevent reuse.

BRIEF DESCRIPTION OF THE DRAWINGS

The present invention will now be described in more detail based on an example of execution represented in the drawings. The figures show.

DETAILED DESCRIPTION

Figure 1:
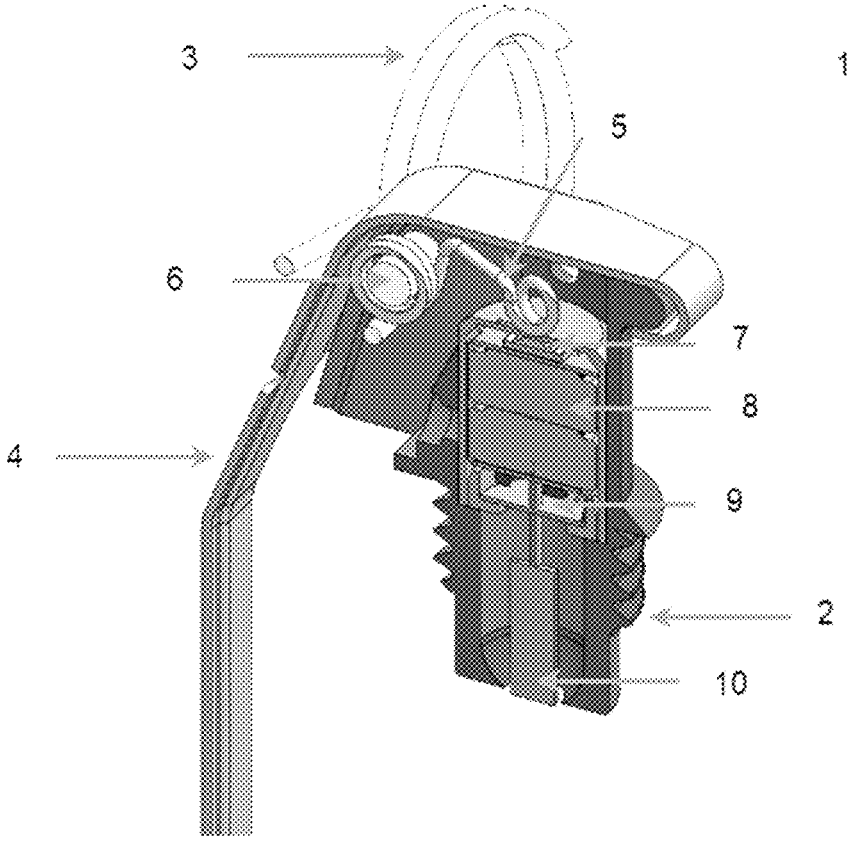
FIG. 1 illustrates the elements that make up the grenade with an EOT-type initiation system.

The electronic time warhead (EOT) fuze 1 is composed of its main elements, such as a body 2, a clamp 3, a handle 4, a spring 5, a spring pin 6, a switch 7, a battery 8, an electronic circuit 9 and a starter element 10.

As can be seen in FIG. 1, the electronic EOT for hand grenade comprises a body 2 that houses a camp 3 with two terminals maintaining a spring 5 and a handle 4 in the armed position. The handle 4 keeps the spring 5 in the armed position while the user wields the grenade. Spring 5 is housed in a pin of spring 6 and this initializes the EOT. During the throwing of the grenade, the spring 5 seeks a resting position, expelling the handle 4 and activating a switch 7 that energizes an electronic circuit 9. A battery 8 is electrically connected to the electronic circuit 9. In addition, an initiating element 10 is mounted on the body 2 and in which the initiator element 10 consists of a conductive filament impregnated with a chemical mixture generating a flame from the electrical signal applied by the electronic circuit 9. The initiator element 10 may be an electrical or electronic component. The electronic circuit 9 is responsible for accounting for a delay time until the grenade's initiating flame is effectively activated. In other words, electronic circuit 9 is a microprocessor circuit that applies an electrical signal to the conductor filament at the end of the delay time, activating the grenade.

Figure 2:
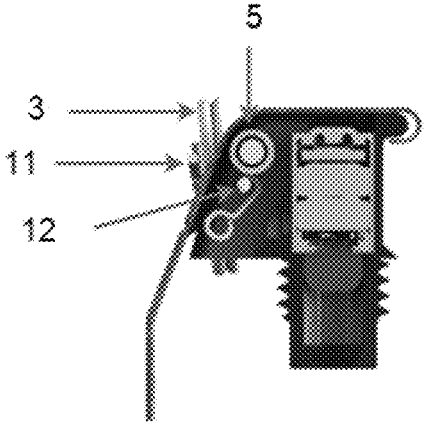
FIG. 2 illustrates the EOT in its armed position.

As can be seen in FIG. 2, the clamp 3 has two terminals, one being a handle terminal 11 and a body terminal 12, which keeps the handle 4 locked in the EOT body 2, causing the spring 5 to remain in the armed position.

Figure 3:
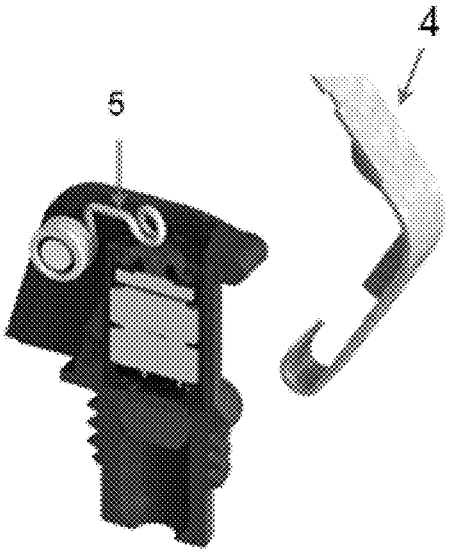
FIG. 3 illustrates the spring in its rest position with expulsion of the handle.

As can be seen in FIG. 3, when removing the clamp 3 and launching the grenade, the spring 5 seeks a resting position, expelling the handle 4 of the EOT. When spring 5 reaches the rest position, it puts pressure on the switch button 7, creating a short circuit between its terminals. Switch 7 can be any type of key or electromechanical mechanism that allows the short circuit between two points to be closed when pressed.

Figure 4:
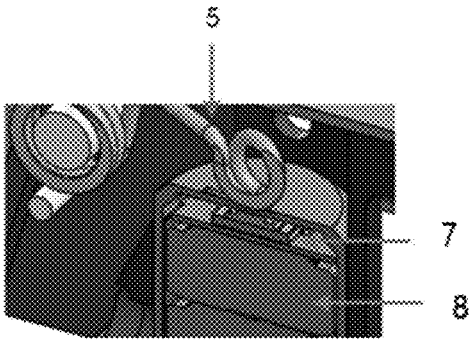
FIG. 4 illustrates the activation of the switch.

As can be seen in FIG. 4, the spring 5 is in its rest position and activating the switch button 7. At this moment the battery 8 is electrically connected to the electronic circuit 9. The battery 8 can be batteries or any other type of device capable of supplying electrical energy.

Figure 5:
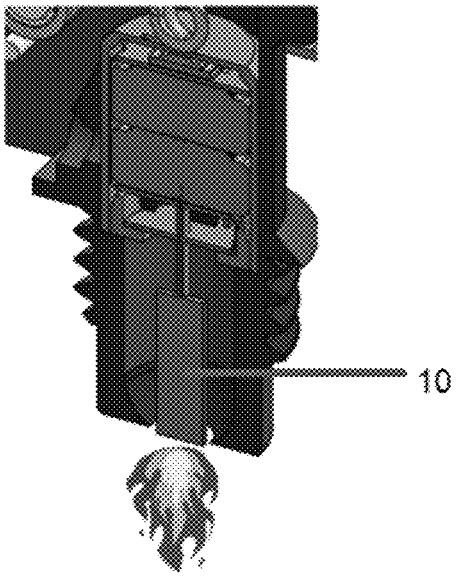
FIG. 5 illustrates the grenade trigger flame.

As can be seen in FIG. 5, when energized, the circuit counts the delay time and generates an electrical signal on the starter filament. This signal generates heat and activates the chemical mixture, resulting, therefore, in the flame that triggers the grenade at the lower end of the initiator element 10. The initiator element 10 can be replaced by a wire or other electrical or electronic component capable of generating heat from low voltage. Therefore, the flame is generated from low battery voltage values 8.

Figure 6:
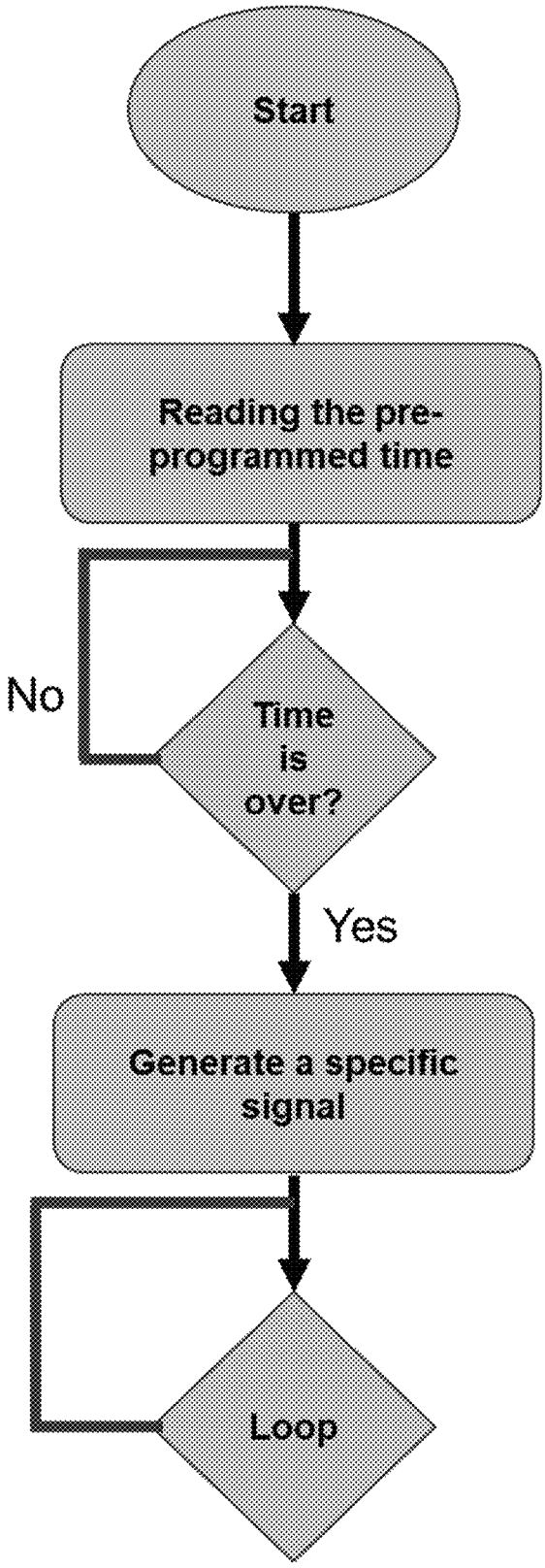
FIG. 6 illustrates a flowchart of the software.

Furthermore, FIG. 6 shows the flowchart of the on-board software to account for a pre-programmed amount of time and generate the specific electrical signal at the end. This signal results in enough heat to generate a flame and consequently trigger the grenade. At the end, it remains in an infinite loop to prevent reuse.

In the first stage, the circuit starts with energization, which subsequently, in a second stage, reads the pre-programmed delay time. After the pre-programmed delay time has elapsed, in the next step, a specific signal is generated, generating the flame and, consequently, activating the grenade. The final step is in an infinite loop, preventing it from being reused.

REFERENCE SIGNS OF FIGURES

1—electronic time warhead fuze (EOT)
2—body
3—clamp
4—handle
5—spring
6—spring pin
7—switch
8—battery
9—electronic circuit
10—initiating element
11—handle terminal
12—body terminal

What is claimed is:

1. An electronic time warhead (EOT) fuze for a hand grenade, comprising:

a body;

a clamp with two terminals keeping a spring and a handle in an armed position;

the handle keeping the spring in the armed position while the user wields the hand grenade;

the spring being housed in a spring pin, wherein the spring initializes the EOT which, when the hand grenade is thrown, seeks a rest position by expelling the handle and activating a switch energizing an electronic circuit;

a battery electrically connected to the electronic circuit; and an initiator element, wherein the initiator element consists of a conductive filament impregnated with a chemical mixture generating an initiating flame from the electrical signal applied by the electronic circuit.

2. The electronic time warhead (EOT) fuze according to claim 1, wherein the initiator element can be an electrical or electronic component.

3. The electronic time warhead (EOT) fuze according to claim 1, wherein the electronic circuit accounts for a delay time until an effective activation of the initiating flame of the hand grenade.

4. The electronic time warhead (EOT) fuze according to claim 3, wherein a microprocessor applies an electrical signal to the conductive filament at the end of the delay time.

5. The electronic time warhead (EOT) fuze according to claim 1, wherein the initiating flame is generated from low voltage values of the battery.

6. A hand grenade, comprising an electronic time warhead (EOT) fuze as defined in claim 1.

* * * * *